US010446950B2

(12) United States Patent
Morello et al.

(10) Patent No.: US 10,446,950 B2
(45) Date of Patent: Oct. 15, 2019

(54) METHOD FOR FORMING A SHIELDED ELECTRICAL TERMINAL AND AN ELECTRICAL TERMINAL FORMED BY SAID METHOD

(71) Applicant: Delphi Technologies, LLC, Troy, MI (US)

(72) Inventors: John R. Morello, Warren, OH (US); James M. Rainey, Warren, OH (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/988,133

(22) Filed: May 24, 2018

(65) Prior Publication Data

US 2018/0375233 A1 Dec. 27, 2018

Related U.S. Application Data

(60) Provisional application No. 62/524,795, filed on Jun. 26, 2017.

(51) Int. Cl.

| | |
|---|---|
| ***H01R 9/22*** | (2006.01) |
| ***H01R 9/05*** | (2006.01) |
| ***H01R 13/6582*** | (2011.01) |
| ***H01R 43/00*** | (2006.01) |
| ***H01R 13/6581*** | (2011.01) |
| ***H01R 43/16*** | (2006.01) |

(52) U.S. Cl.

CPC ..... *H01R 9/05* (2013.01); *H01R 13/6581* (2013.01); *H01R 13/6582* (2013.01); *H01R 43/005* (2013.01); *H01R 43/16* (2013.01)

(58) Field of Classification Search

CPC ..... H01R 9/05; H01R 13/6581; H01R 4/18; H01R 43/16; H01R 43/005; H01R 13/447; H01R 9/0524; H01R 13/6277; H01R 13/506; H01R 13/18; H01R 13/512

USPC ..... 439/894

See application file for complete search history.

(56) References Cited

U.S. PATENT DOCUMENTS

| | | | | |
|---|---|---|---|---|
| 4,655,534 A | | 4/1987 | Stursa | |
| 5,273,456 A | * | 12/1993 | Muzslay | H01R 13/641 439/188 |
| 6,948,976 B2 | * | 9/2005 | Goodwin | H01R 13/512 174/92 |

(Continued)

FOREIGN PATENT DOCUMENTS

| | | |
|---|---|---|
| DE | 25 34 111 A1 | 2/1977 |
| EP | 0 945 931 A2 | 9/1999 |

(Continued)

*Primary Examiner* — Jean F Duverne
(74) *Attorney, Agent, or Firm* — Robert J. Myers

(57) ABSTRACT

A method of forming a shield terminal from sheet metal having a tubular first portion having a single seam and aligned with a first axis and a second tubular portion having two seams radially opposed to one another and aligned with a second axis that is oriented at a right angle to the first axis, an inner insulator disposed within the shield terminal, and an outer housing defining a cylindrical cavity in which the tubular first portion of the shield terminal is disposed. Edges of the single seam and edges of the two seams are joined solely by the disposition of the tubular first portion in the cylindrical cavity. The shield terminal formed by this method is also presented.

8 Claims, 12 Drawing Sheets

(56) References Cited

U.S. PATENT DOCUMENTS

| | | | | |
|---|---|---|---|---|
| 7,467,980 | B2 * | 12/2008 | Chiu | H01R 13/18 439/843 |
| 7,850,472 | B2 * | 12/2010 | Friedrich | H01R 13/506 439/256 |
| 9,147,963 | B2 * | 9/2015 | Balcer | H01R 9/0524 |
| 9,997,857 | B2 * | 6/2018 | Theuwis | H01R 13/447 |
| 10,153,563 | B2 * | 12/2018 | Youtsey | H01R 13/6277 |
| 2007/0232117 | A1 * | 10/2007 | Singer | H01R 4/18 439/352 |

FOREIGN PATENT DOCUMENTS

| | | | |
|---|---|---|---|
| EP | 2 202 852 | A2 | 6/2010 |
| JP | 2008 192498 | A | 8/2008 |

* cited by examiner

INSULATOR - NO FOIL

INSULATOR - COMPLETE FOIL

METHOD FOR FORMING A SHIELDED ELECTRICAL TERMINAL AND AN ELECTRICAL TERMINAL FORMED BY SAID METHOD

CROSS-REFERENCE TO RELATED APPLICATION

This application claims the benefit under 35 USC § 119(e) of U.S. Provisional Patent Application No. 62/524,795 filed on Jun. 26, 2017, the entire disclosure of which is hereby incorporated by reference.

TECHNICAL FIELD OF THE INVENTION

The invention generally relates to coaxial connector assemblies, particularly a method of forming a shielded electrical terminal and a shielded electrical terminal formed by this method.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
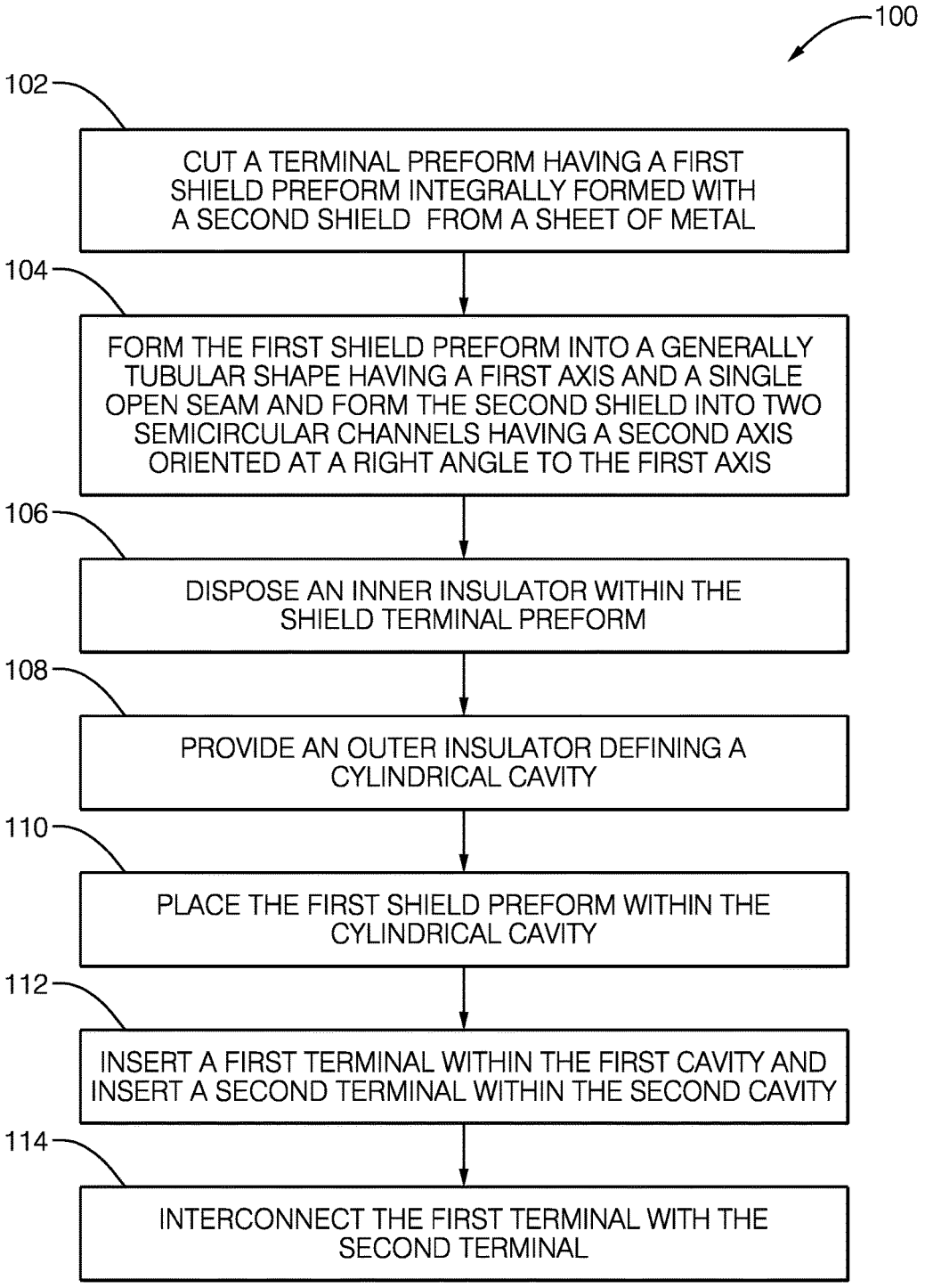
FIG. 1 is a flow chart of a method of forming a shielded electrical terminal configured to receive a corresponding shielded electrical terminal according to an embodiment of the invention.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

FIGS. 1 through 11 illustrate a non-limiting example of a method 100 of forming a shielded terminal 10 that is configured to receive a corresponding shielded terminal. The method 100 includes the following steps:

STEP 102, CUT A TERMINAL PREFORM HAVING A FIRSTSHIELD PREFORM INTEGRALLY FORMED WITH A SECOND SHIELD FROM A SHEET OF METAL, includes cutting a shield terminal preform from a sheet of metal defining a single plane. The shield terminal preform has a first shield preform 12 that is connected to and integrally formed with a second shield preform 14.

Figure 2:
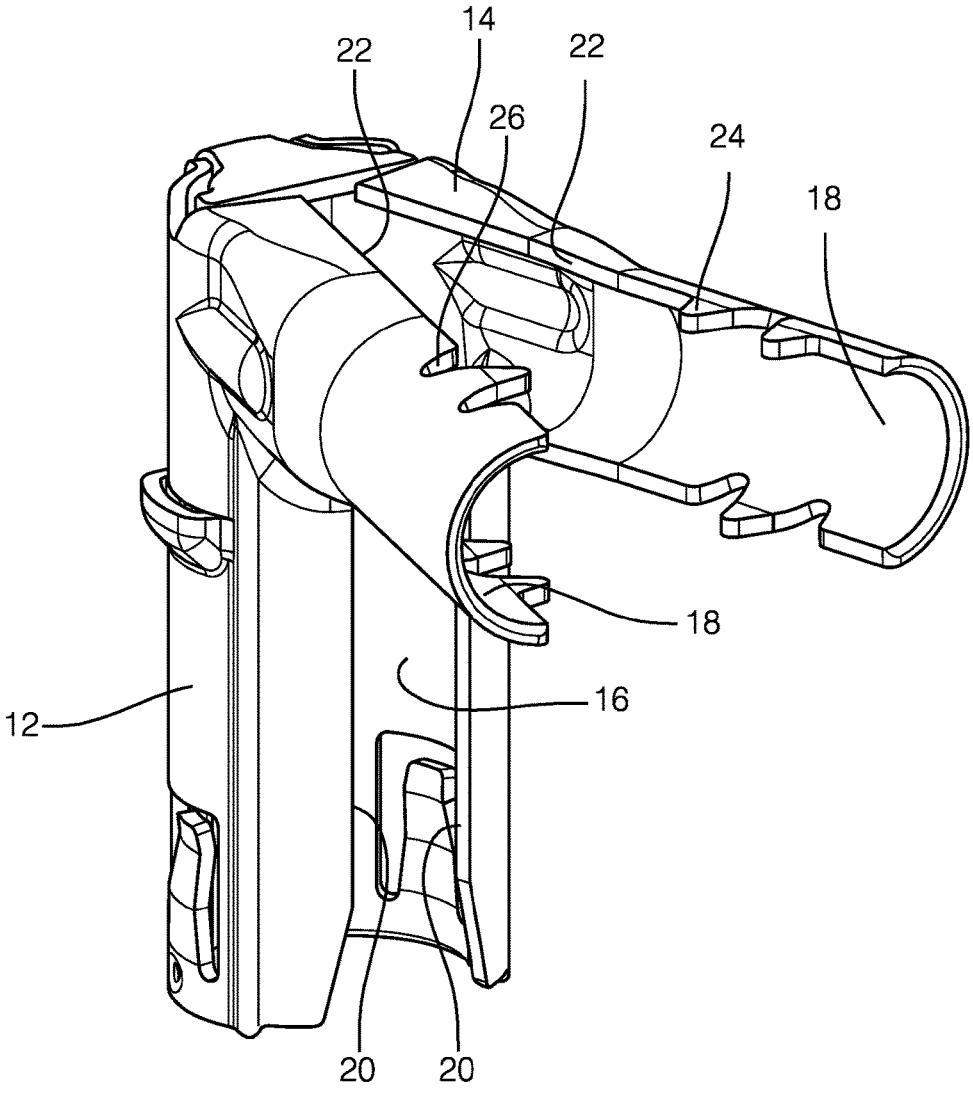
FIG. 2 is a perspective view of a shielded terminal according to an embodiment of the invention.
Figure 3:
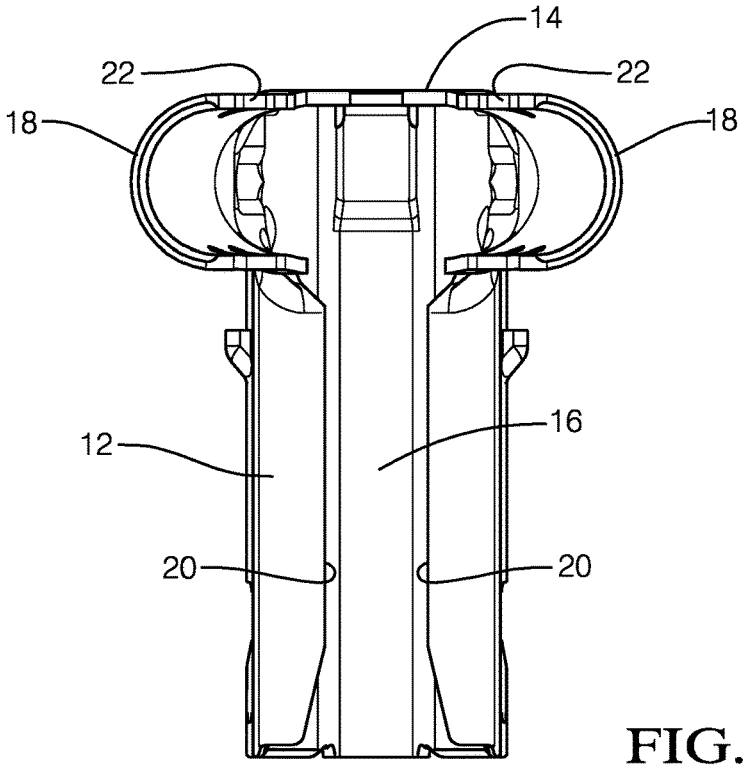
FIG. 3 is a front view of the shielded terminal of FIG. 2 according to an embodiment of the invention.
Figure 4:
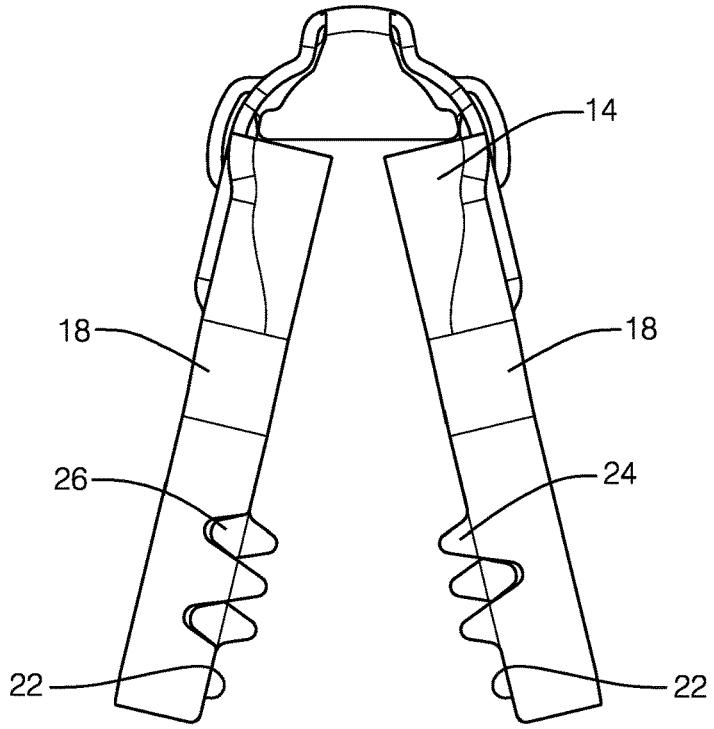
FIG. 4 is a top view of the shielded terminal of FIG. 2 according to an embodiment of the invention.

STEP 104, FORM THE FIRST SHIELD PREFORM INTO A GENERALLY TUBULAR SHAPE HAVING A FIRST AXIS AND A SINGLE OPEN SEAM AND FORM THE SECOND SHIELD PREFORM INTO TWO SEMI-CIRCULAR CHANNELS HAVING A SECOND AXIS ORIENTED AT A RIGHT ANGLE TO THE FIRST AXIS, forming the shield terminal preform such that the first shield preform 12 is formed into a generally tubular shape as illustrated in FIGS. 2-4. The first shield preform 12 extends longitudinally along a first axis, hereinafter referred to as the X-axis. The first shield preform 12 has single open seam 16 extending longitudinally and generally parallel to the X-axis. As further illustrated in FIGS. 2-4, the second shield preform 14 is formed into two semicircular channels 18 having a second axis, hereinafter referred to as the Y-axis, that is oriented at a right angle to the X-axis. The first shield preform 12 and the second shield preform 14 may be formed using a stamping die or other known sheet metal forming techniques. In addition, the sheet metal material used to form the shield terminal preform are well known to those skilled in the art. The edges 20 of the single open seam 16 of the first shield preform 12 and the edges 22 of the two semicircular channels 18 of the second shield preform 14 do not include any features, such as tenons or mortises to interlock the edges 20, 22 together. The two semicircular channels 18 of the second shield preform 14 do include corresponding teeth 24 and sockets 26 that are configure to align the two semicircular channels 18 with one another when they are formed into the second shield 44 but do not interlock with each other.

Figure 5:
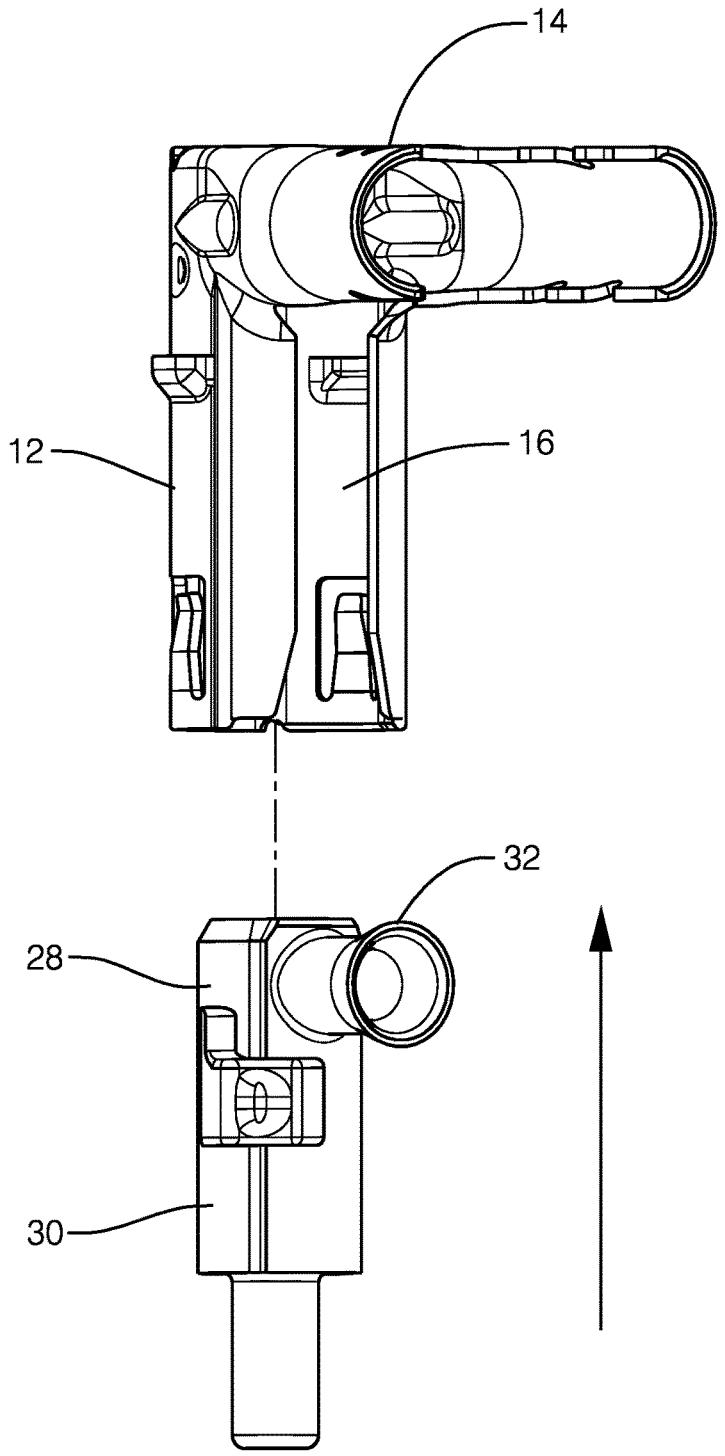
FIG. 5 is an exploded perspective view of the shielded terminal of FIG. 2 and an inner insulator according to an embodiment of the invention.
Figure 6:
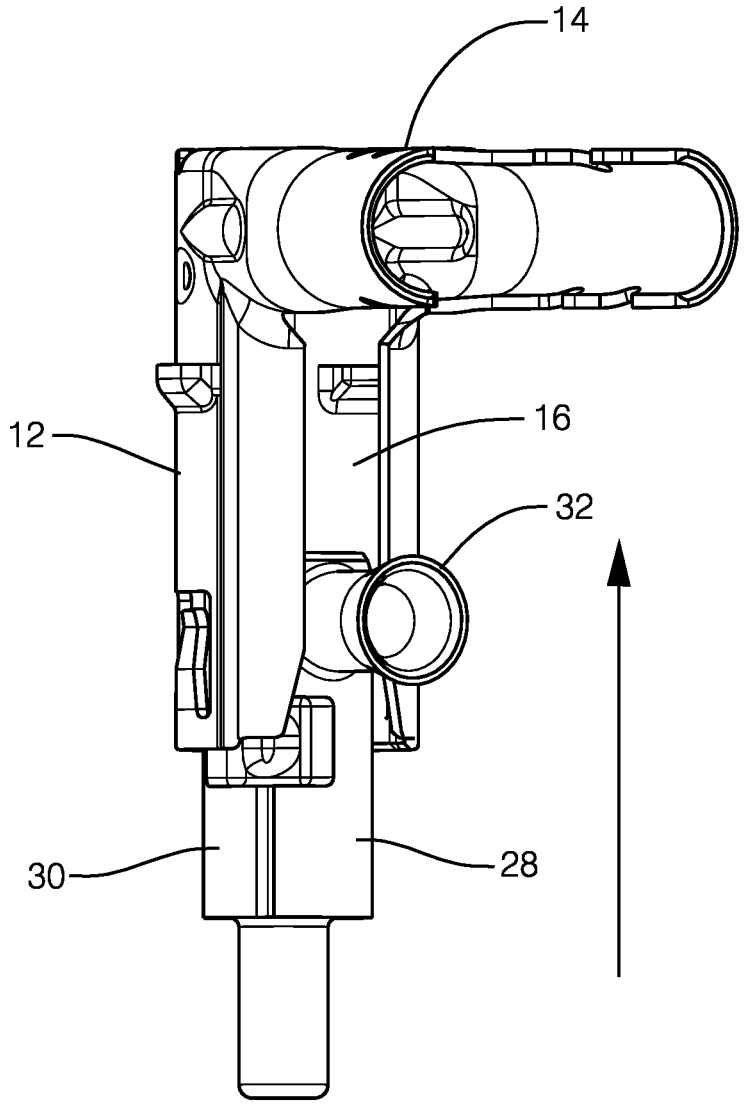
FIG. 6 is perspective view of a partial assembly of the shielded terminal and inner insulator of FIG. 5 according to an embodiment of the invention.
Figure 7:
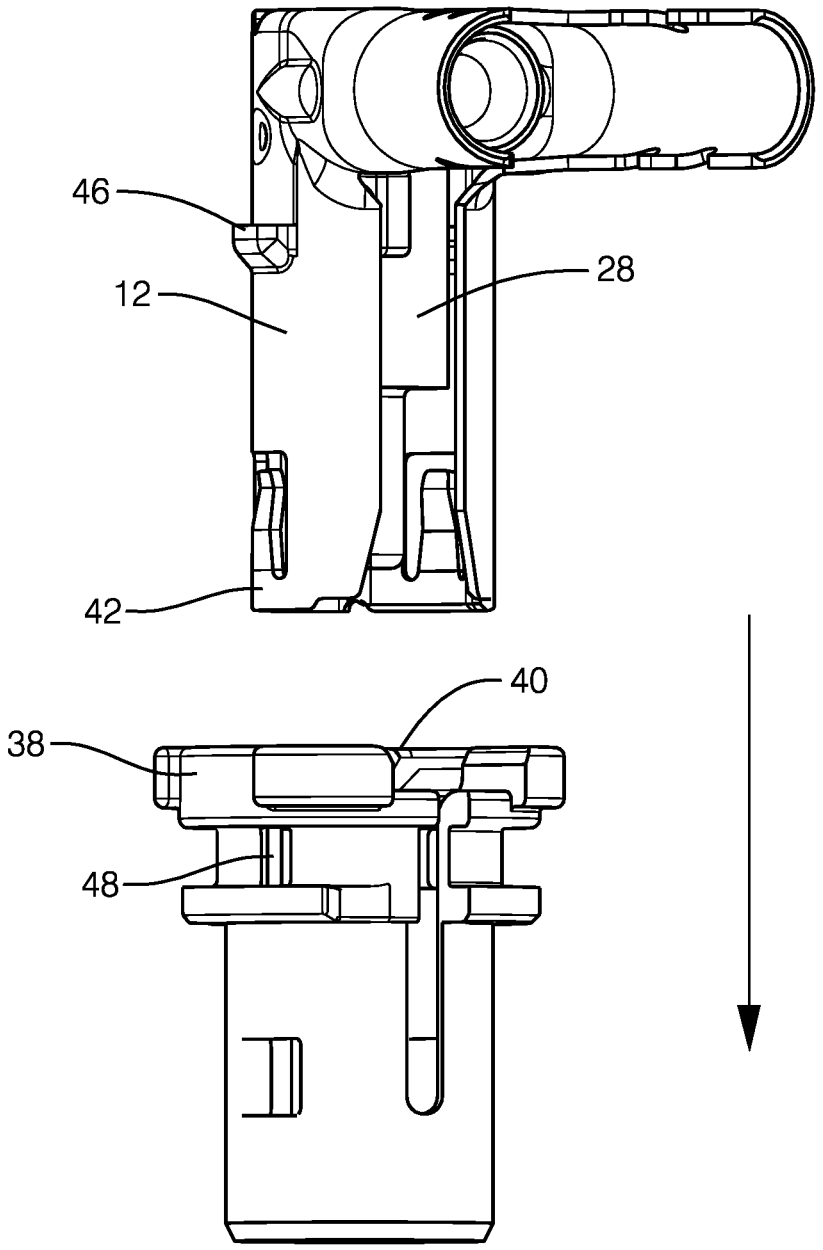
FIG. 7 is an exploded perspective view of the assembled shielded terminal and inner insulator of FIG. 6 and an outer housing according to an embodiment of the invention.
Figure 11:
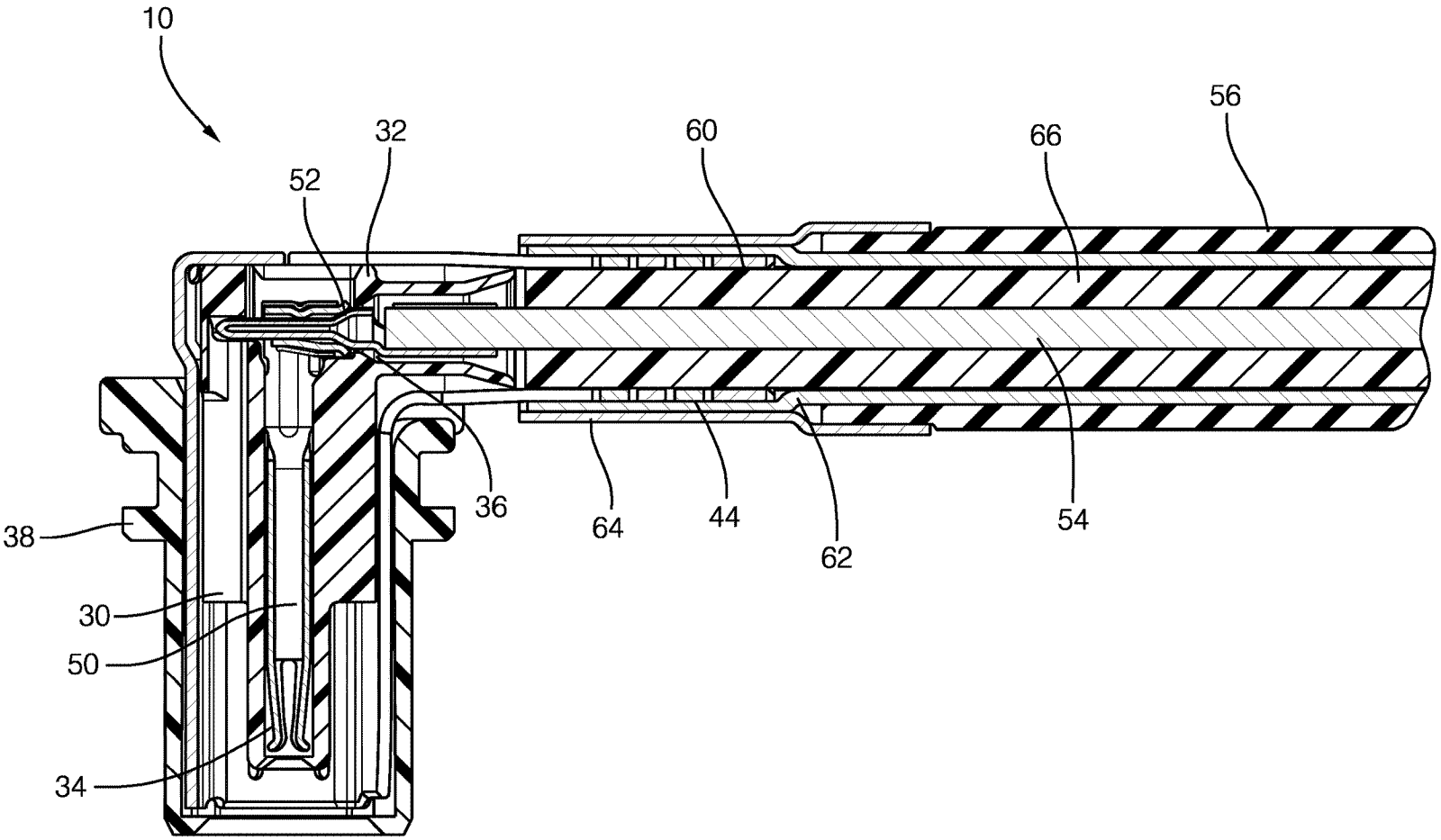
FIG. 11 is a cross section side view of the cable assembly of FIG. 10 according to an embodiment of the invention.

STEP 106, DISPOSE AN INNER INSULATOR WITHIN THE SHIELD TERMINAL PREFORM, includes disposing an inner insulator 28 within the shield terminal preform as illustrated in FIGS. 5-7. The inner insulator 28 has a first inner insulator portion 30 extending longitudinally along the X-axis and a second inner insulator portion 32 integrally formed with the first inner insulator portion 30 and extending longitudinally along the Y-axis. As illustrated in FIG. 6, the width of the single open seam 16 is sufficient to allow passage of the second inner insulator portion 32. As shown in FIG. 7, the first inner insulator portion 30 is disposed within the first shield preform 12 and the second inner insulator portion 32 is disposed within the second shield preform 14. The inner insulator 28 defines a first cavity 34 that extends longitudinally within the first inner insulator portion 30 and is aligned with the X-axis. As best illustrated in FIG. 11, the inner insulator 28 further defines a second cavity 36 that extends longitudinally within the second inner insulator portion 32 and is aligned with the Y-axis. The first cavity 34 intersects and communicates with the second cavity 36. The inner insulator 28 may be formed of a dielectric material, such as 20% glass filled polybutylene terephthalate (PBT).

STEP 108, PROVIDE AN OUTER HOUSING DEFINING A CYLINDRICAL CAVITY, includes providing an outer housing 38 defining a cylindrical cavity 40 as illustrated in FIG. 7. The cylindrical cavity 40 extends longitudinally within the outer housing 38 and is aligned with the X-axis.

Figure 8:
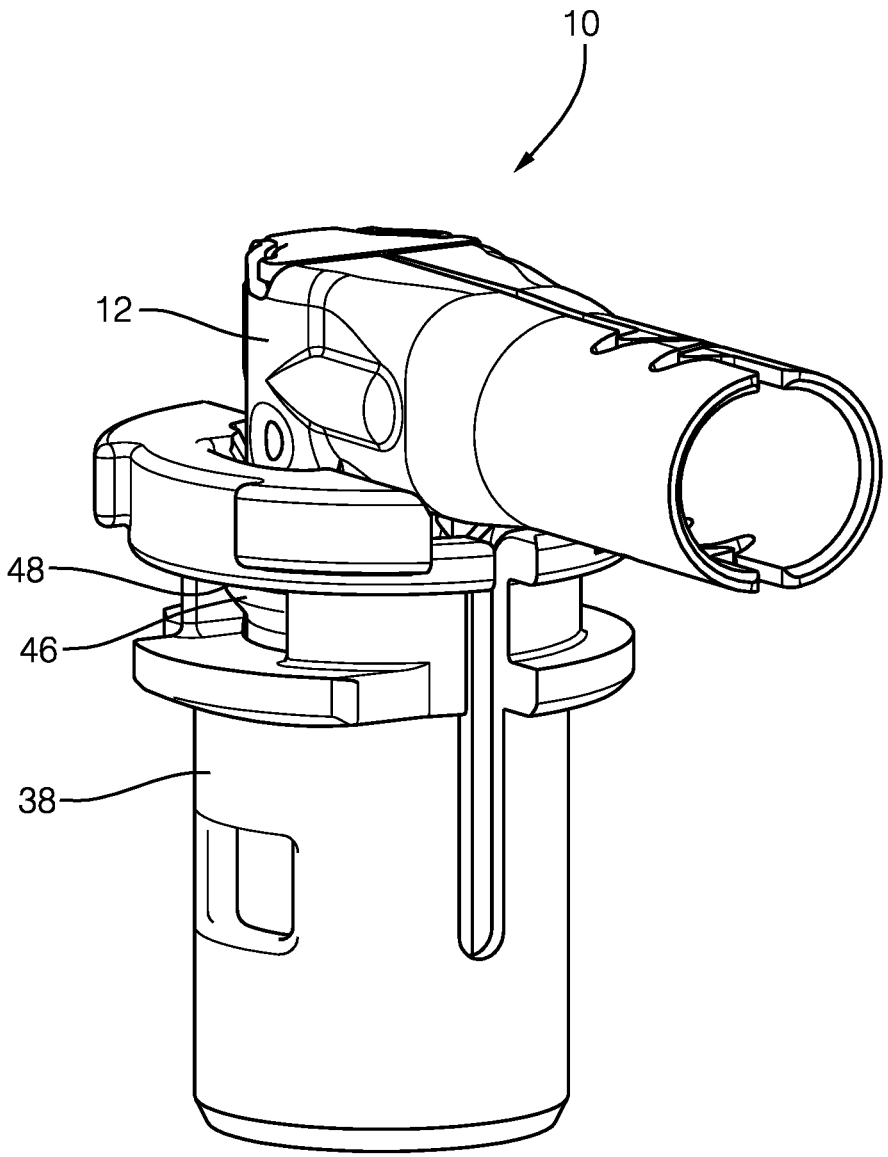
FIG. 8 is a perspective view of a shielded terminal including the assembled shielded terminal and inner insulator of FIG. 6 and the outer housing of FIG. 7 according to an embodiment of the invention.
Figure 9:
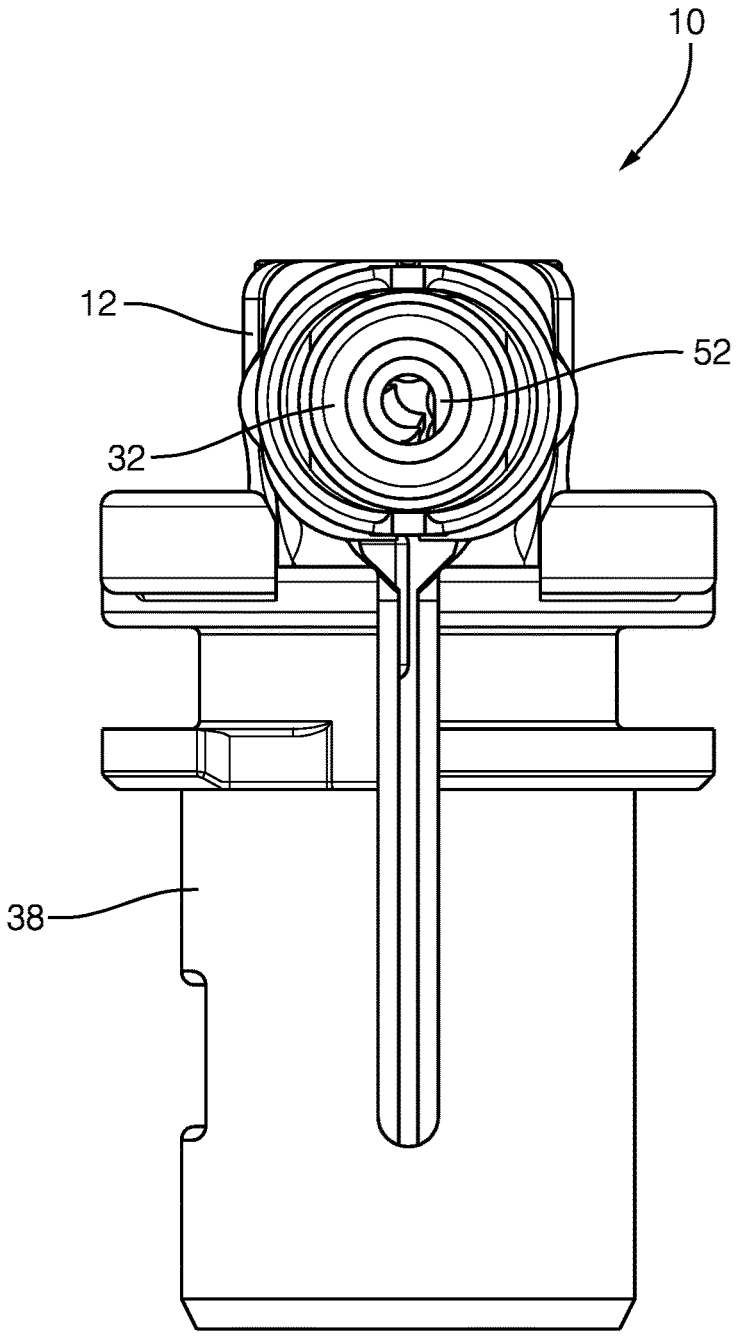
FIG. 9 is a front view of the shielded terminal of FIG. 8 according to an embodiment of the invention.

STEP 110, PLACE THE FIRST SHIELD PREFORM WITHIN THE CYLINDRICAL CAVITY, includes placing the first shield preform 12 within the cylindrical cavity 40, thereby joining the edges 20 of the single open seam 16 to form a tubular first shield 42 and moving the edges 22 of the two semicircular channels 18 closer to form a tubular second shield 44 as illustrated in FIG. 8. The first shield 42 includes snap features 46 configured to engage corresponding features 48 of the outer housing 38 to secure the first shield 42 within the cylindrical cavity 40.

STEP 112, INSERT A FIRST TERMINAL WITHIN THE FIRST CAVITY AND INSERT A SECOND TERMINAL WITHIN THE SECOND CAVITY, includes inserting a first terminal 50 within the first cavity 34 and inserting a second terminal 52 within the second cavity 36 as illustrated in FIG. 11. The first terminal 50 is configured to receive the second terminal 52 and a terminal (not shown) of the corresponding shielded electrical terminal (not shown). The second terminal 52 is configured to be attached to a central conductor 54 of a coaxial cable 56 as shown in FIG. 11. The first terminal 50 is preferably inserted within the first cavity 34 prior to STEP 106.

STEP 114, INTERCONNECT THE FIRST TERMINAL WITH THE SECOND TERMINAL, includes interconnecting the first terminal 50 with the second terminal 52 as illustrated in FIG. 11. The second terminal 52 is preferably connected to the central conductor 54 of the coaxial cable 56 prior to STEP 114.

Figure 10:
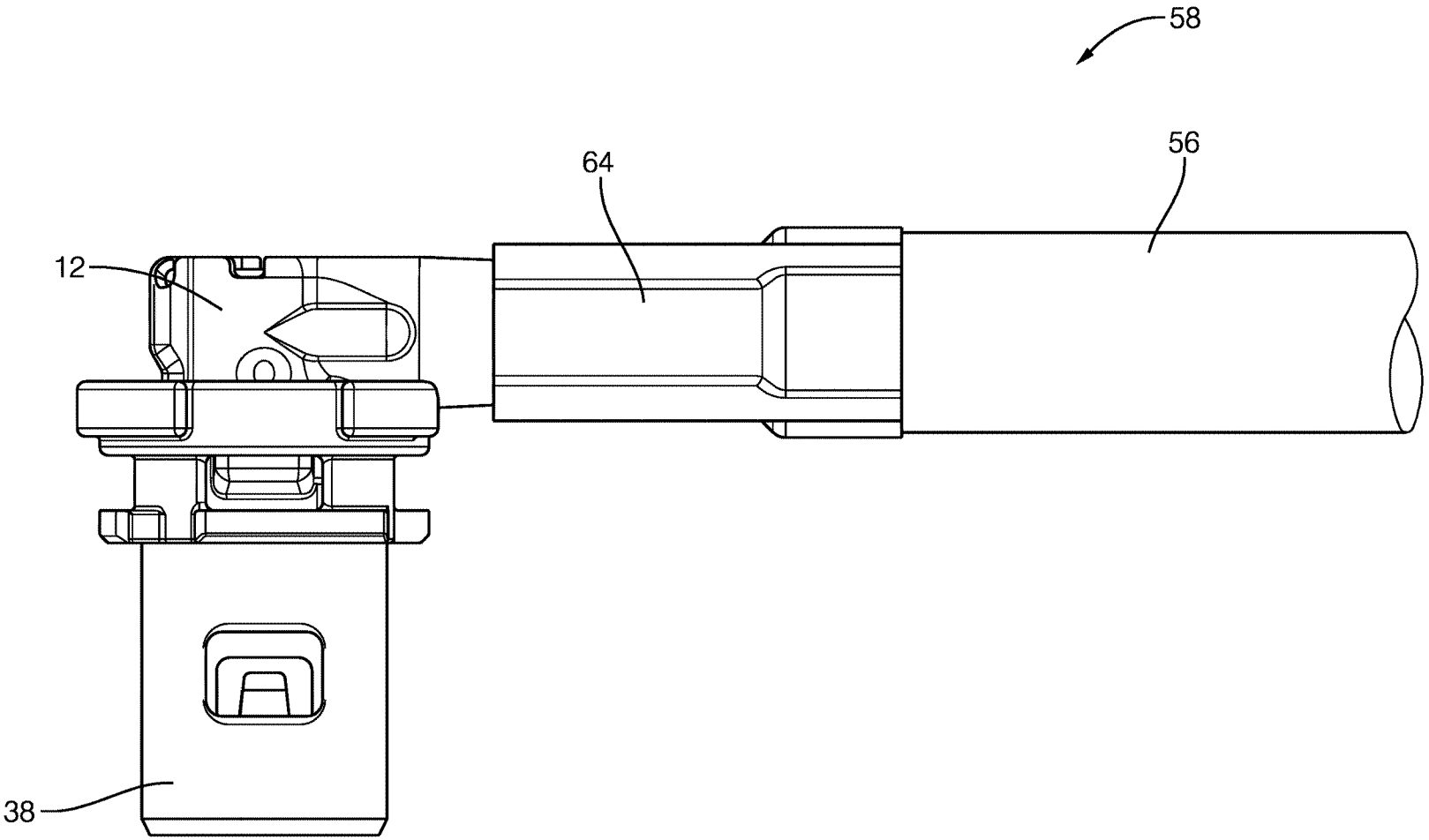
FIG. 10 is a side view of a cable assembly including the shielded terminal of FIG. 8 according to an embodiment of the invention.

FIGS. 10 and 11 illustrate a shielded cable assembly 58 including the central conductor 54 of the coaxial cable 56 attached to the first terminal 50. The coaxial cable 56 further includes and a foil shield 60 that is disposed with the second shield 44 and a braided shield 62 that is in contact with an outer surface of the second shield 44. The braided shield 62 is secured to the second shield 44 by an outer ferrule 64.

The braided shield 62 is flared and dressed outside of the second shield 44. However, the foil shield 60 is left surrounding an inner dielectric insulation 66 between the foil shield 60 and the central conductor 54, and is inserted inside of the second shield 44. An unterminated cable has the best ratio for the intended impedance, and the longer that set ratio exists, the less fluctuation there is from the desired impedance. The foil shield 60 is minimally stripped back from the edge of the inner dielectric insulation 66 to prevent a short circuit with the central conductor 54 within a factor of safety. A longer foil shield 60 is better so the edges 22 of the two semicircular channels 18 remain slightly parted to allow easier insertion of the foil shield 60 within the second shield 44. The edges 22 of the two semicircular channels 18 are joined when the outer ferrule 64 is applied.

Figure 12A:
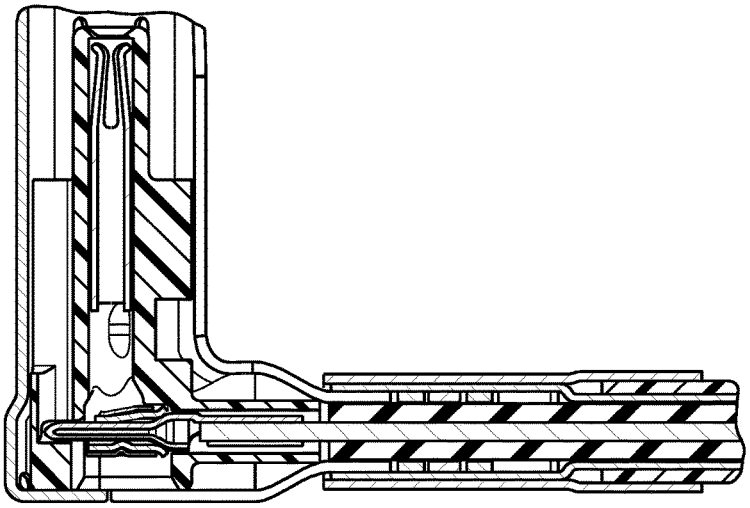
FIG. 12A is a cross section side view of the cable assembly of FIG. 10 without foil according to an embodiment of the invention.
Figure 12B:
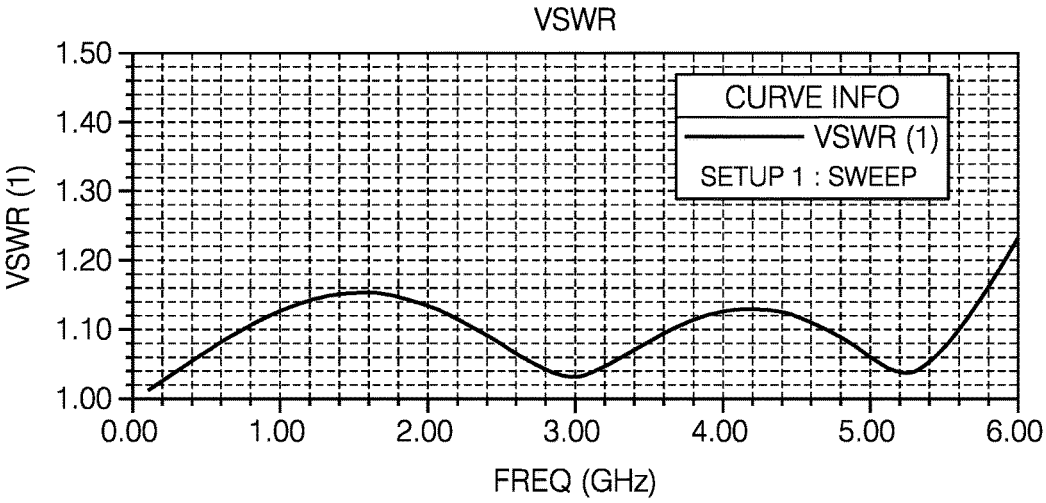
FIG. 12B is a graph of voltage standing wave ratio (VSWR) performance of the cable assembly of FIG. 12A according to an embodiment of the invention.
Figure 13A:
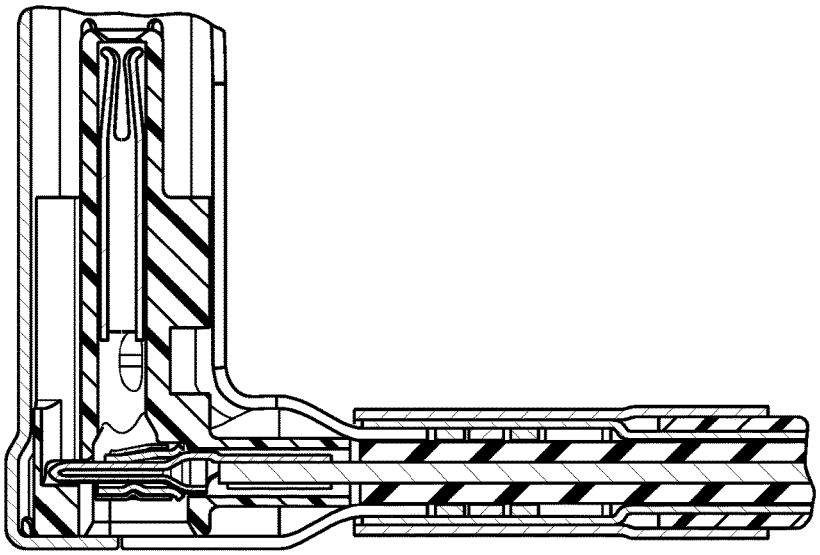
FIG. 13A is a cross section side view of the cable assembly of FIG. 10 with foil according to an embodiment of the invention.
Figure 13B:
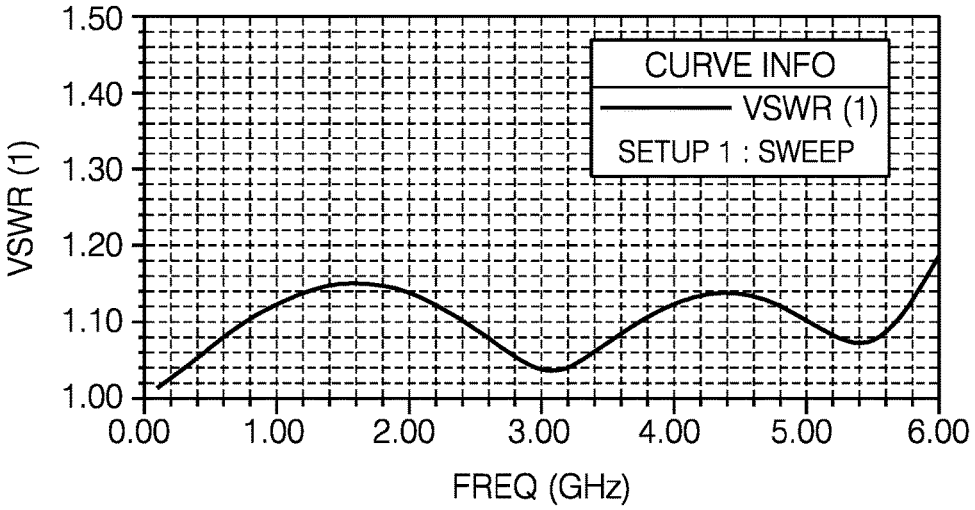
FIG. 13B is a graph of VSWR performance of the cable assembly of FIG. 13A according to an embodiment of the invention.

FIG. 12B is a simulation of voltage standing wave ratio (VSWR) performance of the cable assembly when there is a condition where none of the foil shield 60 is disposed within the second shield 44 as illustrated in FIG. 12A and FIG. 13B is a simulation VSWR performance of the cable assembly when there is a condition where the foil shield 60 is fully disposed within the second shield 44 as illustrated in FIG. 13A.

Accordingly a method 100 of forming a shielded terminal 10 configured to receive a corresponding shielded terminal 10 and a formed by this method 100 is provided. The shielded terminal 10 provides the benefit of reduced part count, fewer manufacturing steps and simpler manufacturing processes than previous methods and shielded terminal 10 designs.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A method of forming a shielded electrical terminal configured to receive a corresponding shielded electrical terminal, comprising the steps of:

a) cutting a shield terminal preform from a sheet of metal defining a single plane, said shield terminal preform having a first shield preform integrally formed with a second shield preform;

b) forming the shield terminal preform such that the first shield preform is formed into a generally tubular shape having a first axis and single open seam and the second shield preform is formed into two semicircular channels having a second axis that is oriented at a right angle to the first axis;

c) disposing an inner insulator within the shield terminal preform;

d) providing an outer housing defining a cylindrical cavity; and e) placing the first shield preform within the cylindrical cavity, thereby joining edges of the single open seam and joining the two semicircular channels to form a tubular shape.

2. The method according to claim 1, wherein the inner insulator defines a first cavity aligned with the first axis and a second cavity intersecting the first cavity, said second cavity aligned with the second axis and wherein the method further comprises the steps of:

f) inserting a first terminal within the first cavity and inserting a second terminal within the second cavity; and g) interconnecting the first terminal with the second terminal.

3. A shielded electrical terminal configured to receive a corresponding shielded electrical terminal, said shielded electrical terminal formed by a method comprising the steps of:

a) cutting a shield terminal preform from a sheet of metal defining a single plane, said shield terminal preform having a first shield preform integrally formed with a second shield preform;

b) forming the shield terminal preform such that the first shield preform is formed into a generally tubular shape having a first axis and single open seam and the second shield preform is formed into two semicircular channels having a second axis that is oriented at a right angle to the first axis;

c) disposing an inner insulator within the shield terminal preform;

d) providing an outer housing defining a cylindrical cavity; and e) placing the first shield preform within the cylindrical cavity, thereby joining edges of the single open seam and joining the two semicircular channels to form a tubular shape.

4. The shielded electrical terminal according to claim 3, wherein the inner insulator defines a first cavity aligned with the first axis and a second cavity intersecting the first cavity, said second cavity aligned with the second axis and wherein the method further comprises the steps of:

f) inserting a first terminal within the first cavity and inserting a second terminal within the second cavity; and g) interconnecting the first terminal with the second terminal.

5. A shielded electrical terminal configured to receive a corresponding shielded electrical terminal, comprising:

a shield terminal formed from sheet metal having a tubular first portion having a single seam and aligned with a first axis and a second tubular portion having two seams radially opposed to one another and aligned with a second axis that is oriented at a right angle to the first axis;

an inner insulator disposed within the shield terminal; and an outer housing defining a cylindrical cavity in which the tubular first portion of the shield terminal is disposed, wherein edges of the single seam and edges of the two seams are joined solely by the disposition of the tubular first portion in the cylindrical cavity.

6. The shielded electrical terminal according to claim 5, wherein the inner insulator defines a first cavity aligned with the first axis and a second cavity intersecting the first cavity, said second cavity aligned with the second axis and wherein the shielded electrical terminal further comprises:

a first terminal disposed within the first cavity;

a second terminal disposed within the second cavity and interconnected to the first terminal.

7. The shielded electrical terminal according to claim 5, wherein the outer housing is formed of 20% glass filled polybutylene terephthalate.

8. The shielded electrical terminal according to claim 5, wherein the inner insulator is formed of 20% glass filled polybutylene terephthalate.

* * * * *